United States Patent [19]

Long

[11] 4,149,049

[45] Apr. 10, 1979

[54] SWITCH USING RESILIENT ANNULAR CONTACTOR

[75] Inventor: Eric L. Long, Lincoln, Ill.

[73] Assignee: Cutler-Hammer, Inc., Milwaukee, Wis.

[21] Appl. No.: 860,381

[22] Filed: Dec. 14, 1977

[51] Int. Cl.[2] ..... H01H 23/24

[52] U.S. Cl. ..... 200/67 G; 200/68; 200/277; 200/339

[58] Field of Search ..... 200/67 R, 67 AA, 67 D, 200/67 DA, 67 DB, 67 G, 68, 275, 277, 153 LB, 339; 74/97

[56] References Cited

U.S. PATENT DOCUMENTS 2,847,529 8/1958 Munn ..... 200/67 R 3,032,620 5/1962 Silberg ..... 200/68 X

*Primary Examiner*—Herbert F. Ross

[57] ABSTRACT

An electrically conductive annular elastic contactor is trapped in a cavity in a housing defined by a bottom wall and left and right side walls. A movable operator cammingly engages the contactor, compressively deforming it until an overcenter position is passed, after which the contactor snaps against the opposite side wall to make and/or break contact with stationary contacts mounted on at least one of the walls. The contactor acts both as the movable contact for engaging stationary contacts and as snap action biasing means for effecting switching operations. Due to the resilient deformation of the contactor, there is afforded a torsional shearing of contact welds.

9 Claims, 5 Drawing Figures

SWITCH USING RESILIENT ANNULAR CONTACTOR

BACKGROUND OF THE INVENTION

Snap action switches utilizing stored energy of resilient biasing means is known. Switches utilizing resilient loops to effect switching operations are also known. While these switches have been useful for their intended purposes, the present invention relates to improvements thereover.

SUMMARY OF THE INVENTION

An object of the invention is to provide an improved snap action electric switch.

Another object is to provide a simple, low cost switch of the aforementioned character with a minimum number of parts.

Another object is to provide a switch of the aforementioned character which torsionally shears contact welds.

Another object is to provide a switch of the aforementioned character having a closed-loop resilient contactor which acts as both a snap action overcenter blasing means and as a movable contact.

Another object is to provide a switch of the aforementioned character wherein the contactor is freely trapped in a cavity in the switch housing whereby the contactor is neither mounted to the switch housing nor to a movable operator.

DESCRIPTION OF THE PREFERRED EMBODIMENT

Figure 1:
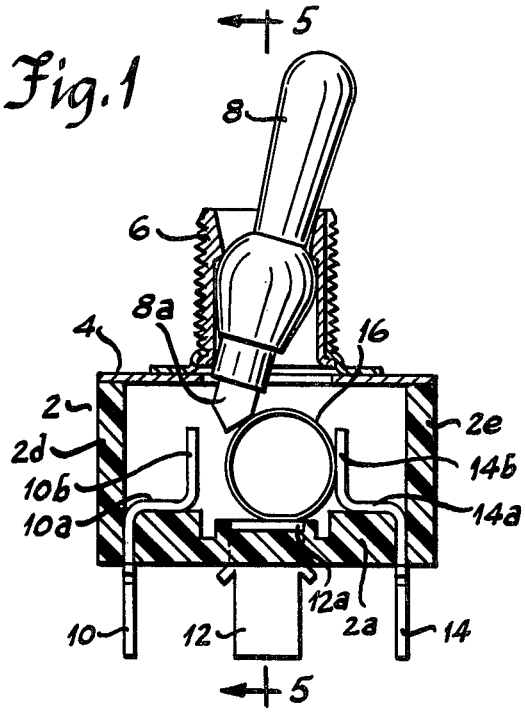
FIGS. 1–4 show a cross-sectional view of a switch constructed in accordance with the invention, and sequentially illustrate operation thereof.

There is shown in FIG. 1 an electric switch having a housing comprising an open-topped insulating base 2 covered by a cover 4 having a threaded bushing 6 extending upwardly therefrom away from base 2. Pivotally mounted in the bushing is a toggle lever 8 which extends into the interior of the housing.

Three terminals 10, 12 and 14 extend from below the housing, up through the bottom **2*a* of the base and then into the interior of the housing. Central terminal 12 is a common terminal and its portion 12*a* inside the housing is flat and horizontal, lying against the interior bottom of the base. Left and right terminals 10 and 14 have central horizontal portions 10*a* and 14*a* extending along the interior bottom of the base and vertical upstanding portions 10*b* and 14*b*** within the housing.

Figure 5:
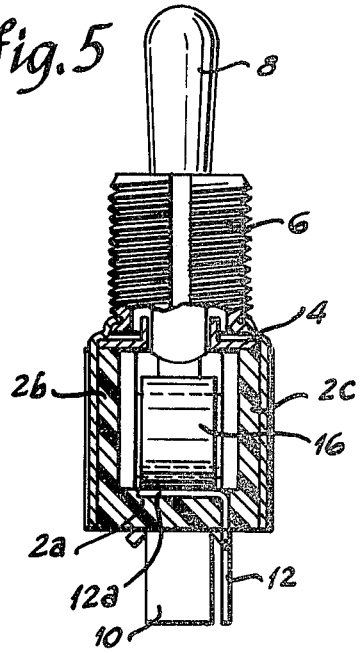
FIG. 5 is a cross-sectional view taken along line 5—5 of FIG. 1.

These terminals form a cavity in the switch housing, such cavity having a bottom horizontal wall defined by terminal portion **12*a* and base bottom 2*a*, a left vertical wall defined by terminal portion 10*b*, and a right vertical wall defined by terminal portion 14*b*. Also defined in the cavity are front and rear walls 2*b* and 2*c*, respectively, FIG. 5**, of the base.

Freely trapped in the cavity is an annular elastic metal contactor 16. The diameter of contactor 16 is less than the distance between terminal portions **10*b* and 14*b*. The toggle lever has a lower camming portion 8*a* which, during pivotal movement of the toggle lever, defines a line of travel which is spaced from terminal portion 12*a* a distance less than the diameter of contactor 16**.

Figure 2:
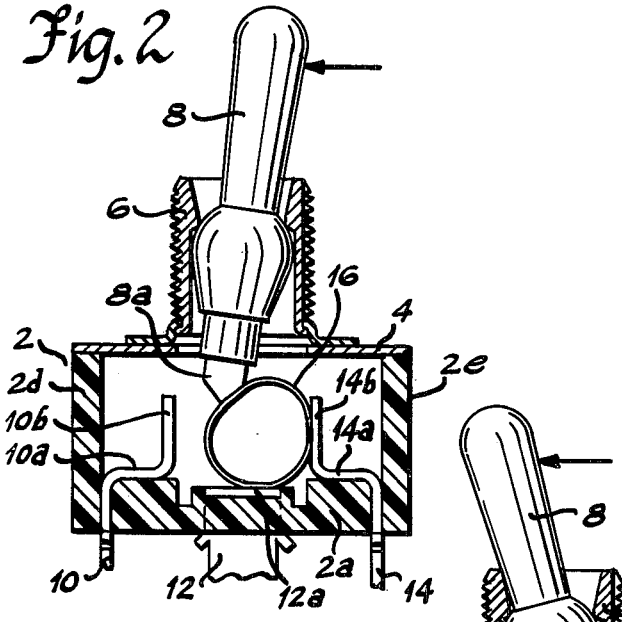
Figure 3:
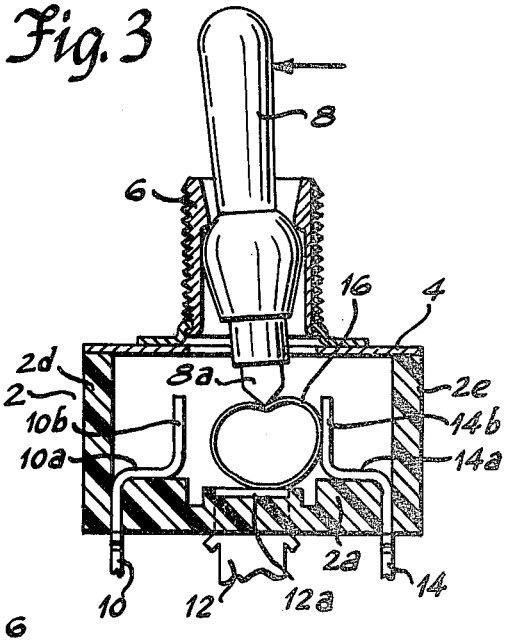
Figure 4:
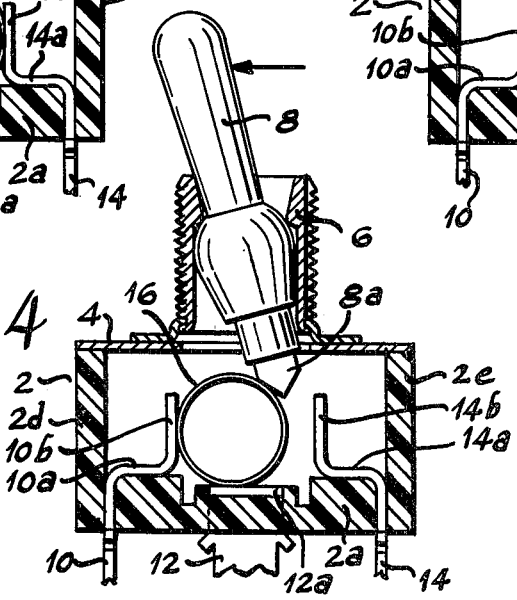

Operation of the switch can now be described. Referring to FIG. 1, it is seen that with toggle lever 8 in a fully clockwise pivoted position, camming portion **8*a* is left of center of contactor 16 which is held in a slightly compressed state so as to afford sufficient bias to ensure firm contact with terminal portions 12*a* and 14*b*, thus completing a circuit therebetween. As the toggle lever is pivoted counterclockwise, FIG. 2, cam portion 8*a* moves rightwardly, cammingly compressing and deforming contactor 16. Deformation of contactor 16 at surfaces 12*a* and 14*b* torsionally shears contact welds therebetween. Continued counterclockwise pivoting of the toggle lever causes further deformation of contactor 16 until an overcenter position is reached, FIG. 3, after which the energy stored in the contactor during deformation thereof is released and the contactor snaps leftwardly against terminal portion 10*b*, FIG. 4, to complete a circuit between terminals 12 and 10**.

Contact force increases prior to break because of the increasing deformation of the contactor, to thus assure a crisp unfluttering break and prevent teasing of the contacts. Cleaning and wiping of common terminal portion **12*a* is provided by the effective rolling thereacross of contactor 16. Due to the resilient deformation of contactor 16, there is afforded a torsional shearing effect between the contactor and terminal portions 10*b*, 12*a* and 14*b*** to thus break contact welds, frictional attachments, etc., and hence prevent hang-up of the switch.

The retention cavity in which the contactor is trapped may have other forms than shown in the preferred embodiment. For example, the left and right vertical side walls **2*d* and 2*e* may comprise the left and right cavity walls against which the contactor is snapped, with different dimensioning of the switch, wherein stationary contact means may be mounted at one or both of the walls 2*d* and 2*e***. Generally, the means which form the cavity should: (a) provide a distance between the left and right cavity walls which is greater than the diameter of the contactor to afford engagement of only one cavity side wall at a time, to thus permit a switching function to be performed; and (b) provide a distance between the bottom cavity wall and at least a segment of the line of travel of the camming portion of the actuator which is less than the diameter of the contactor to ensure deformation of the contactor upon movement of the actuator through an overcenter condition to afford a change of position of the contactor. The cavity thus permits the contactor to be freely trapped therein without being mounted to the actuator or the base.

The contactor is preferably made of a soft metal having good electrical conductivity, such as copper. A closed-loop band, preferably in the shape of an annulus, is formed in order to provide resiliency to the contactor. This elastic configuration allows energy to be stored in the contactor upon deformation, which energy is released upon return of the contactor to its normal configuration, thus enabling the contactor to act both as biasing means and as a movable contact.

Though a double throw, single pole switch is shown, other embodiments are possible. For example, front and rear stationary contacts may be disposed at the right side wall of the cavity to be bridged by the contactor in the position shown in FIG. 1, with the remaining stationary contacts being eliminated or unused to thus afford a single throw, single pole switch, with the off condition shown in FIG. 4. As another example, front and rear stationary contacts may be disposed on both the right side wall and on the bottom wall of the cavity to afford a single throw, double pole switch wherein the contactor bridges a bottom contact and a respective right side contact in an on condition shown in FIG. 1; front and rear stationary contacts could also be disposed on the left side wall of the cavity to provide a double throw, double pole switch.

The invention is also susceptible of other types of actuators, for example, a left-right linearly reciprocal actuator having a downwardly extending V-shaped cam which engages the contactor.

It is recognized that various modifications are possible within the scope of the appended claims.

What is claimed is:

1. An electric switch comprising:

a housing;

means defining a cavity in said housing, said cavity having a bottom wall and left and right spaced side walls;

stationary contact means disposed at at least one of said walls;

a resiliently deformable cylindrical electrically conductive contactor freely trapped in said cavity;

actuator means movably mounted to said housing for oscillating movement in a plane normal to the axis of said cylinder for deforming said contactor in response to movement of said actuator means such that said contactor snaps left or right along said bottom wall against said right or left side wall as said actuator means passes through an overcenter engagement point with said contactor.

2. The switch according to claim 1 wherein said contactor rolls along said bottom wall and said actuator means cammingly and slidingly engages said contactor from above, said contactor acting as both a snap action biasing means and as a movable contact, resilient deformation of said contactor causing torsional shearing between said contactor and said stationary contact means.

3. The switch according to claim 2 wherein said contactor has a diameter which is less than the distance between said right and left side walls of said cavity to afford engagement of only one of said cavity side walls at a time by said contactor, and wherein said diameter is greater than the distance between said bottom wall and at least a segment of the line of travel of actuator means to ensure deformation of said contactor upon movement of said actuator means through said overcenter engagement point with said contactor.

4. The switch according to claim 3 having a first stable position wherein said contactor engages said bottom and said right side walls of said cavity, and a second stable position wherein said contactor engages said bottom and said left side walls of said cavity, said actuator means holding said contactor in a slightly deformed condition in at least one of said stable positions to ensure sufficient contact pressure, said contact pressure being increased as a result of increasing deformation of said contactor as said actuator means is moved toward said overcenter engagement point with said contactor, whereby to prevent teasing between said contactor and said stationary contact means.

5. The switch according to claim 1 wherein said contactor is made of metal.

6. The switch according to claim 1 wherein said contactor is a metal band having an axis perpendicular to actuator movement.

7. The switch according to claim 4 wherein said contactor is a metal band having an axis perpendicular to actuator movement.

8. A simple, low cost, snap action electric switch having a minimum number of parts, comprising:

a housing;

means defining a cavity in said housing, said cavity having a bottom wall and left and right spaced side walls;

stationary contact means disposed at at least one of said walls;

an annular resiliently deformable metal band contactor forming a cylinder freely trapped in said cavity; and a single-element integral actuator movably mounted to said housing and having an outer manually engageable portion and an inner portion extending interiorly of said housing to directly engage said contactor in camming relation from above;

said contactor acting as both the movable contact and as the sole snap action biasing means, such that in response to movement of said actuator in a plane normal to said band, said inner portion thereof compressively deforms said contactor until an overcenter engagement point is passed, whereafter said contactor snaps left or right along said bottom wall against said left or right side wall, resilient deformation of said contactor causing torsional shearing between said contactor and said stationary contact means.

9. The switch according to claim 8 wherein said actuator has a first stable position wherein said contactor engages said bottom and said right walls of said cavity, and a second stable position wherein said contactor engages said bottom and said left side walls of said cavity, said inner portion of said single-element integral actuator directly and slightly compressively engaging said contactor in at least one of said stable positions to ensure sufficient contact pressure, said contact pressure being increased as a result of increasing deformation of said contactor as said actuator is moved toward said overcenter engagement point with said contactor, whereby to prevent teasing between said contactor and said stationary contact means.

* * * * *